US010357974B2

(12) United States Patent
Murphy et al.

(10) Patent No.: US 10,357,974 B2
(45) Date of Patent: Jul. 23, 2019

(54) PRINTING FLUID SUPPLY CARRIER

(71) Applicant: Hewlett-Packard Development Company, L.P., Houston, TX (US)

(72) Inventors: Bryan Murphy, Kildare (IE); William Jon Rittgers, Kildare (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/752,429

(22) PCT Filed: Sep. 2, 2015

(86) PCT No.: PCT/EP2015/001771
§ 371 (c)(1),
(2) Date: Feb. 13, 2018

(87) PCT Pub. No.: WO2017/036487
PCT Pub. Date: Mar. 9, 2017

(65) Prior Publication Data
US 2019/0009556 A1 Jan. 10, 2019

(51) Int. Cl.
*B41J 2/175* (2006.01)
*B41J 29/13* (2006.01)

(52) U.S. Cl.
CPC ..... *B41J 2/17509* (2013.01); *B41J 2/1752* (2013.01); *B41J 2/17523* (2013.01); *B41J 2/17553* (2013.01); *B41J 29/13* (2013.01)

(58) Field of Classification Search
CPC .... B41J 2/17509; B41J 29/13; B41J 2/17523; B41J 2/1752; B41J 2/17553
See application file for complete search history.

(56) References Cited

U.S. PATENT DOCUMENTS

| | | | | |
|---|---|---|---|---|
| 6,139,135 | A | 10/2000 | Becker et al. | |
| 6,241,347 | B1 | 6/2001 | Becker et al. | |
| 6,280,025 | B1 * | 8/2001 | Beckstrom | B41J 2/17503 222/325 |
| 6,338,553 | B1 | 1/2002 | Lewis et al. | |
| 6,945,639 | B2 | 9/2005 | Lee | |

(Continued)

FOREIGN PATENT DOCUMENTS

| | | |
|---|---|---|
| CN | 201745244 | 2/2011 |
| JP | 2008164798 | 7/2008 |
| WO | 00749492 | 12/2000 |

OTHER PUBLICATIONS

International Searching Authority, "International Search Report and Written Opinion," issued in connection with PCT patent application No. PCT/EP2015/001771, dated May 26, 2017, 11 pages.

(Continued)

*Primary Examiner* — Henok D Legesse
(74) *Attorney, Agent, or Firm* — HP Inc. Patent Department

(57) ABSTRACT

A replaceable printing fluid supply carrier for a continuous ink supply system of a printer is described in some examples. The printing fluid supply carrier comprises a printing fluid container carrier and a cover part connected to the printing fluid container carrier. When the printing fluid supply carrier is installed to the printer with a supply door opening an opening to a printing fluid supply area the cover part covers the opening to the printing fluid supply area.

11 Claims, 5 Drawing Sheets

(56) References Cited

U.S. PATENT DOCUMENTS

| | | | |
|---|---|---|---|
| 8,308,269 | B2 | 11/2012 | Omer et al. |
| 2005/0034777 | A1 | 2/2005 | Nicodem et al. |
| 2006/0289081 | A1 | 12/2006 | Nicodem et al. |
| 2008/0122879 | A1 | 5/2008 | Nicodem et al. |

OTHER PUBLICATIONS

Epson, "Continuous Ink Supply System Installation Instruction for Epson Workforce 630 635 840 845 530 545 645 7510 7010 7520 60 3520 3540 Printer," Feb. 21, 2013, 5 pages.

* cited by examiner

PRINTING FLUID SUPPLY CARRIER

BACKGROUND

Printing fluid cartridges located within a printer have a predetermined amount of printing fluid contained within the cartridge. Those cartridges dispense printing fluid through a print head. A continuous ink supply system (CISS) is configured to draw printing fluid into the cartridges. This printing fluid being drawn into the cartridges is called "continuous ink". Thus, a CISS may increase printing capacity and allow customers to use inexpensive aftermarket printing fluids for being used with a printer.

BRIEF DESCRIPTION OF THE DRAWINGS

Examples will be described, by way of example only, with reference to the accompanying drawings in which corresponding reference numerals indicate corresponding parts and in which.

DETAILED DESCRIPTION

A CISS architecture comprises a large refillable printing fluid supply and a tubing, wherein the CISS is connected via the tubing to a printing fluid cartridge of a printer. Thus, a CISS implemented to a printer may reduce printing costs when compared to the use of original equipment manufacturer (OEM) printing fluid cartridges. However, implementing a CISS may involve the tubing to be flexible enough for the supply door of the printer to be closed while maintaining flow of printing fluid.

Thus, a printing fluid supply carrier for a continuous ink supply system is described. The printing fluid supply carrier includes a printing fluid container carrier and a cover part, wherein the cover part is connected to the printing fluid container carrier. The cover part may act as a supply door closing an opening to a printing fluid supply area when the printing fluid supply carrier is installed to the printer, i.e., when the supply door of the printer opens the opening.

Figure 1:
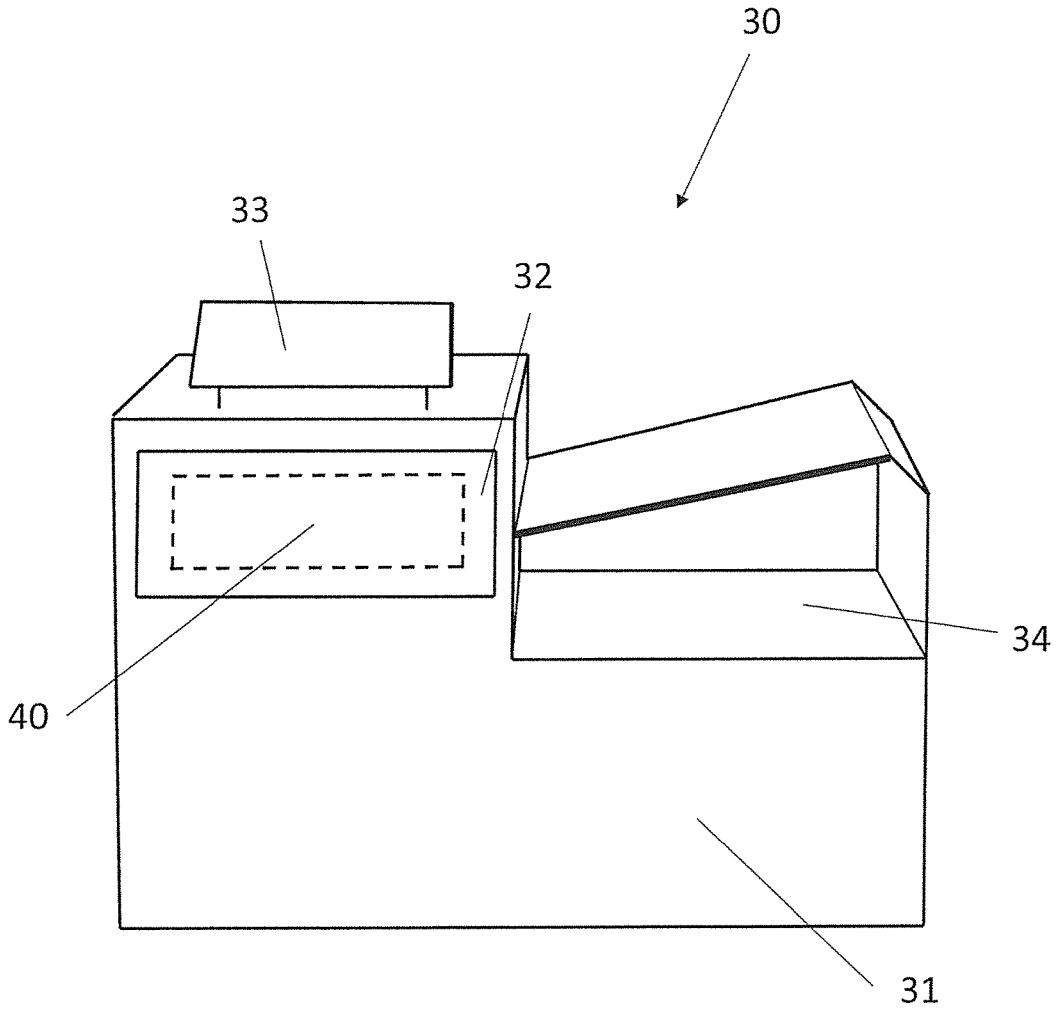
FIG. 1 is a side view of a schematic illustration of an example printer comprising a housing and a supply door.

Now referring to FIG. 1, which illustrates an example printer 30 comprising a housing 31 and a supply door 32 being closed. In some examples, the printer is an ink jet type printer. The supply door 32 is attached to the housing 31. In some examples, the supply door 32 is attached to the housing 31 by a hinge. In some examples, the hinge is used to position the supply door 32 relative to the housing 31 and to control the path of the supply door 32 swing. The housing 31 has several side walls, wherein one side wall comprises the supply door 32. The supply door 32 is in a closed state thereby covering an opening to a printing fluid supply area 40 (illustrated by dashed rectangular lines, indicating that the printing fluid supply area 40 is not apparent when the supply door 32 is closed) within the housing 31. The supply door 32 is to selectively open and close the opening. In some examples, the supply door 32 can be opened by pulling outward on release buttons located at the housing 31. In some examples, the supply door 32 swings open when a push-to-open switch is pressed.

In some examples, the printer 30 comprises a sensor to detect the supply door 32 having closed the opening to the printing fluid supply area 40. In some examples, the sensor comprises a switch with terminals to connect signal wires and a sensor counter-part to actuate the switch when the supply door 32 is in a closed state. In some examples, the sensor comprises a magnetic switch (such as a reed switch), and the sensor counter-part comprises a magnet to actuate the magnetic switch. The magnet mounts to the supply door 32, and the switch of the sensor mounts to the housing 31, or vice versa. When the supply door 32 is closed the magnet and the magnetic switch are a certain distance apart. When the supply door 32 is opened, this distance may increase thereby toggling the switch. In some examples, the printer 30 is in operational state when the sensor detects that the supply door 32 is closed.

In some examples, the printer may have a display 33 for controlling several printer functions by a user. The display 33 may be mounted on an upper part of the housing 31 in a user-friendly position.

The one side wall comprising the supply door 32 may further include an opening area 34 from which a free space extends into the housing 31 for accommodating the printing fluid supply carrier (not shown in FIG. 1). The free space extending into the housing is encompassed by a supporting surface for supporting the printing fluid supply carrier 10, two sides and a top cover above the supporting surface. Through the opening area 34 the printing fluid supply carrier can be inserted. In some examples, the outer surface of the top cover serves as an output tray of the printer 30 wherein the output tray has an inclination. In some examples, the output tray inclines down towards the print output area. In some examples, the top cover is removably arranged to the housing 31.

Figure 2:
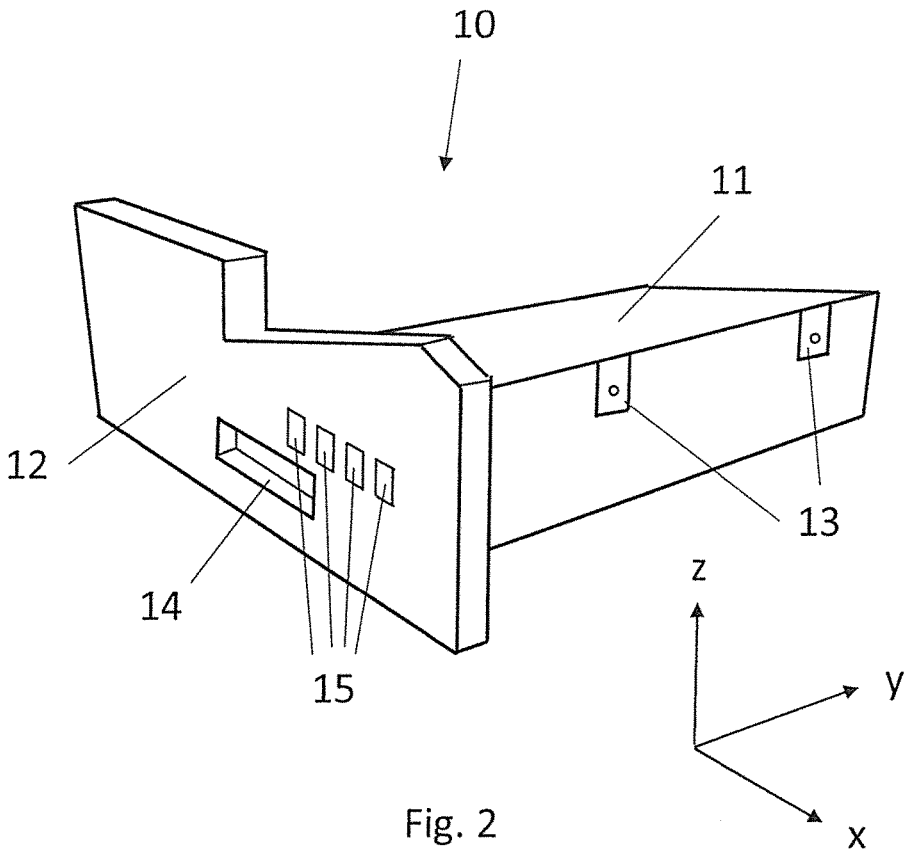
FIG. 2 is an illustration of an example printing fluid supply carrier comprising a printing fluid container carrier and a cover part connected to the printing fluid container carrier.

Now referring to FIG. 2, which illustrates an example printing fluid supply carrier 10 comprising a printing fluid container carrier 11 and a cover part 12 connected to the printing fluid container carrier 11. The term "connected" herein may refer to any sort of physical attachment. The term "connected" can be understood herein as encompassing integrally (such as one piece), permanently (such as glued, welded, etc.), or detachably connected (such as snap-fit, screwed, etc.). The printing fluid supply carrier 10 is suitable for a CISS usable for the printer 30. In some examples, a CISS is an automatic printing fluid refill system, and is generally a system to deliver a large volume of printing fluid to a comparatively small printing fluid cartridge. A CISS may comprise printing fluid containers and tubing for connecting the printing fluid containers to a standard printer cartridge.

When the printing fluid supply carrier 10 is installed to the printer 30 with a supply door 32 opening the opening to a printing fluid supply area 40 the cover part 12 covers the opening to the printing fluid supply area 40, reducing, or in one instance even removing, the need of closing the supply door 32. The term "installed" in relation to the printing fluid supply carrier 10 can be understood herein in a sense that the printing fluid supply carrier 10 is placed in a loose or unlockable locked manner at a specific place of the printer, where it is supported by the printer. The specific place is selected such that, with the printing fluid supply carrier 10 installed to the printer 30 and the supply door 32 uncovering the opening to the printing fluid supply area 40, the cover part 12 covers the opening to the printing fluid supply area 40 in lieu of the supply door 32.

In one example, the printing fluid container carrier 11 and the cover part 12 which are part of the printing fluid supply carrier 10 are in one piece. In another example, the printing fluid supply carrier 10 comprises two parts, namely the printing fluid container carrier 11 and the cover part 12, which are e.g. screwed or glued together. The printing fluid supply carrier 10 forms a replaceable unit. In some examples, the printing fluid supply carrier 10 can be replaceably installed to the printer housing 31. In some examples, when the printing fluid supply carrier 10 is installed to the printer 30 the printing fluid container carrier 11 is encompassed by the printer housing 31. In some examples, the printing fluid supply carrier 10 is suitable for a CISS.

For the sake of a more comprehensive description, non-restrictive coordinate axes in x-, y- and z-directions are added to FIG. 2.

In some examples, the printing fluid container carrier 11 of the printing fluid supply carrier 10 is a carrier for carrying refill printing fluid containers including refilling printing fluid and being part of the CISS. The printing fluid container carrier 11 may extend in x-, y- and z-direction and may form a closed case. In some examples the case can be opened to insert components of the CISS, such as the refill printing fluid containers or the tubing for connecting the CISS to the printer 30. In some examples, the printing fluid container carrier 11 comprises a bottom side to support the refill printing fluid containers or other components of the CISS within the printing fluid container carrier 11, side walls in x-direction and y-direction and an upper side to cover the refill printing fluid containers or other components of the CISS. In some examples, the printing fluid container carrier 11 comprises a refill printing fluid container to be fluidly connected via the opening to the printing fluid supply area 40 with a printing fluid container located inside the printer housing. In some examples, the refill printing fluid container is fluidly connected to a cartridge of a printer by the tubing. Thus, the printing fluid container carrier 11 protectively covers the connecting tubing of the CISS. Further, the tubing are unconstrained to vertical movement.

The cover part 12 is arranged at one side of the printing fluid container carrier 11. In some examples, the cover part 12 replaces the one side of the printing fluid container carrier 11, thereby closing the one side of the printing fluid container carrier 11. In some examples, the cover part 12 has a projecting part that projects the one side of the printing fluid container carrier 11 in x-z-direction. In some examples, the projecting part has a rectangular surface that projects to the left or to the right from the one side of the printing fluid container carrier 11.

The cover part 12 may extend also in y-direction. In some examples, the cover part 12 comprises a hollow body having a front wall and a back wall connected via top, bottom and/or side walls. In some examples, the back wall has an container carrier opening being adapted to the shape of the one side of the printing fluid container carrier 11 to which the cover part 12 is connected, an supply door opening being adapted to accommodate the supply door 32 opening the opening to the printing fluid supply area 40, and an supply area opening being adapted to the shape of the opening to the printing fluid supply area 40. The tubing runs in the hollow of the cover part 12 between the container carrier opening and the supply area opening. In some examples, the cover part 12 cover part comprises a massive body wherein the massive body has guides to guide the tubing from the printing fluid container carrier 11 to the opening of the printing fluid supply area 40, and a recess to accommodate the supply door 32 opening the opening to the printing fluid supply area 40.

The cover part 12 of the printing fluid supply carrier 10 may comprise a sensor counter-part 22 (illustrated schematically by dashed lines, indicating that the sensor counter-part is not apparent) functioning as a counter-part of the printer's 30 sensor that detects the supply door 32 having closed the opening to the printing fluid supply area 40. The sensor counter-part 22 of the cover part 12 may allow the sensor of the printer 30 to detect that the opening to the printing fluid supply area 40 is covered by the cover part 12, when the printing fluid supply carrier 10 is installed to the printer 30. In some examples, the sensor counter-part 22 of the printing fluid supply carrier 10 comprises a magnet being integrated within the cover part 12 of the printing fluid supply carrier 10. In this context, the term "integrated" can be understood in a sense that the magnet is screwed or glued on the cover part 12. The term "integrated" also comprises that the magnet is integrated during manufacture of the cover part 12. In some examples, the magnet is mounted to the cover part 12 at a location that is identical to the location of the magnet mounted to the supply door 32 when covering the opening to the printing fluid supply area 40. Thus, the sensor of the printer 30 is able to detect both, either the closed supply door 32 or the covering cover part 12. In some examples, when the printing fluid supply carrier 10 is installed to the printer 30 the magnet mounted to the cover part 12 and the switch mounted to the housing 31 are a certain distance apart. When the printing fluid supply carrier 10 is not installed, e.g. when not engaged with the one side of the printer housing 31, this distance may increase thereby toggling the magnetic switch. The printer 30 is in operational state when the sensor detects that either the supply door 32 is closed or the cover part 11 of the printing fluid supply carrier 10 is fully engaged with the one side of the printer housing 31.

The printing fluid supply carrier 10 may comprise any rigid plastic material such as polyethylene (PE), polycarbonate (PC) or acrylonitrile butadiene styrene (ABS). In one example, the material of the cover part 12 is identical to the material of the printer housing 31 to provide a clean OEM look. In some examples, the surface color of the cover part 11 corresponds with the color of the printer housing 31. In some examples, the printing fluid container carrier 11 comprises a transparent material such as polyethylene terephthalate (PET) to allow the customer checking the filling level of refill printing fluid containers arranged within the printing fluid container carrier 11 without involving the printing fluid container carrier 11 to be opened. In some examples, the printing fluid container carrier 11 has sections made of the transparent material apart from otherwise opaque material, wherein each of the sections made of the transparent material provides a user a view to a corresponding refill printing fluid container in order to allow the customer to check the filling level. In some examples, the printing fluid container carrier 11 comprises a non-transparent material.

In some examples, the cover part 12 is made of a transparent material. In some examples, at least one section is arranged in the front wall of the cover part 12 to offer the customer a view of the fill level of a corresponding refill printing fluid container within the printing fluid container carrier 11. In some examples, the at least one section may be a transparent wall part of the cover part 12. In some examples, the at least one section may be an open window in the cover part 12. In some examples, a level indicator 15 is arranged on the cover part 12 which is to indicate the fill level of refill printing fluid containers within the printing fluid container carrier 11. In some examples, the level indicator may be a riser tube connected to a corresponding refill printing fluid container wherein the riser tube is arranged at the front wall of the cover part 12. In some examples, the material characteristics, the surface quality and the surface color of the printing fluid supply carrier 10 correspond to the material characteristics, the surface quality and the surface color of the printer housing 31.

Figure 3:
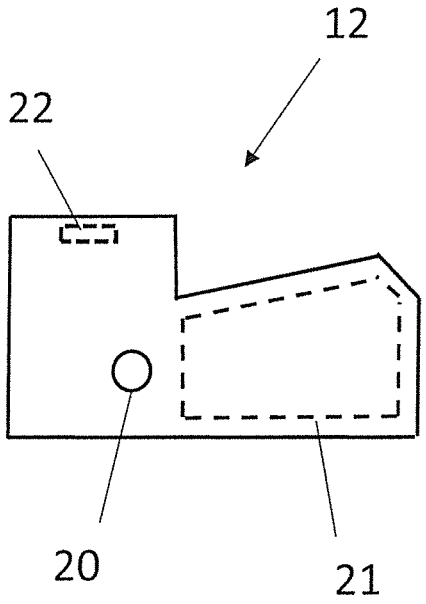
FIG. 3 is a plan view of a schematic illustration of an example cover part of the example printing fluid supply carrier.

Now referring to FIG. 3, which illustrates a plan view of the example cover part 12. The plan view offers a view on the front wall of the cover part 12. The front wall of the cover part 12 has a non-trivial geometric form. The left side of the front wall which belongs to the protruding part of the cover part 12 has a substantially rectangular form, wherein the right side which covers and extends beyond the one side 21 (illustrated by dashed lines, indicating that the one side of the printing fluid container carrier 11 is not apparent) of the printing fluid container carrier 11 is formed to correspond substantially with the circumference of the one side 21 of the printing fluid container carrier 11. In this context, substantially rectangular means that the basic shape of the cover part 12 is rectangular, while details of the cover part 12 may deviate from the rectangular shape. In some examples, the shape of the cover part 12 is entirely rectangular. In some examples, the front wall includes a brand label 20 to give a clean OEM look to the cover part 12. In some examples, the front wall of the cover part 12 may be formed rectangular, oval or circular or may comprise any suitable form which fits with the dimensions of the one side of the printer housing 31 and which covers at least the opening to the printing fluid supply area 40. In some examples, the cover part 12 comprises a handle area 14 (shown in FIG. 2) to selectively remove and insert the printing fluid supply carrier 10 to the housing 31. In some examples, the handle area 14 may be a recessed grip.

Figure 4:
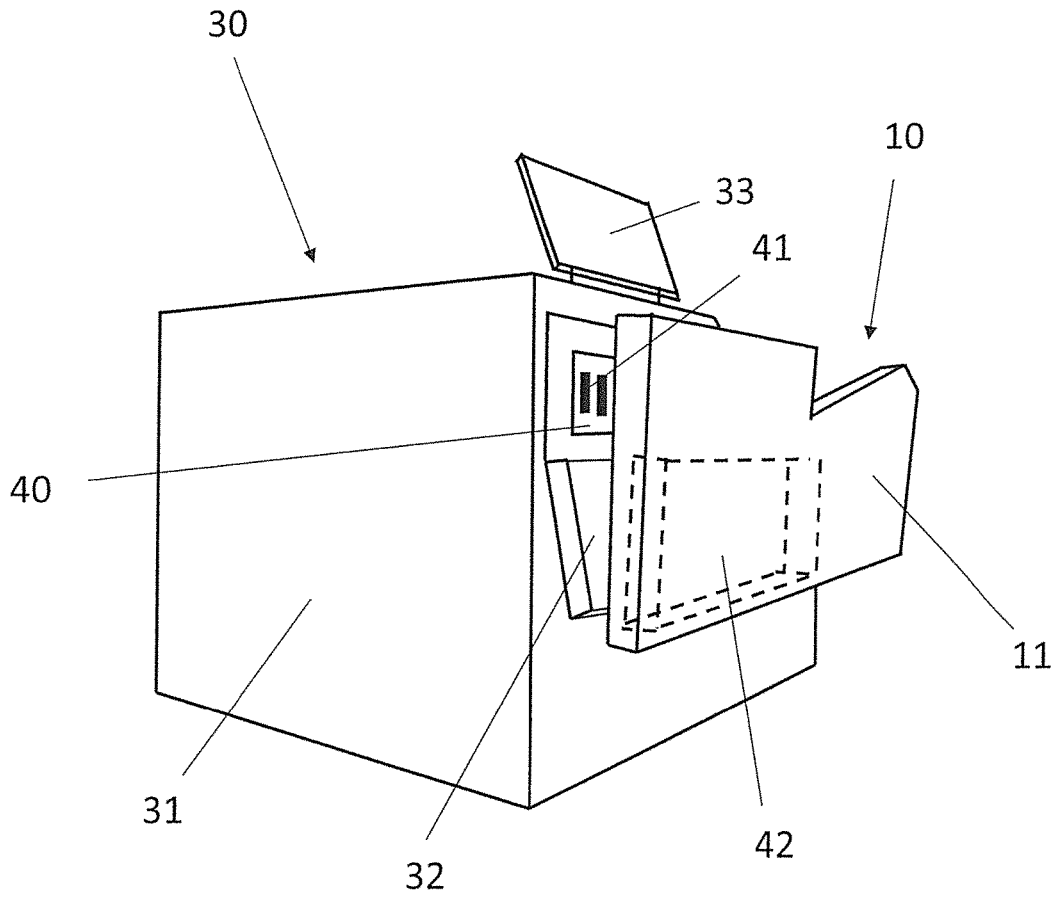
FIG. 4 is a further side view of a schematic illustration of the example printer comprising the housing, the supply door and the example printing fluid supply carrier during installation to the printer.

Now referring to FIG. 4, which illustrates the example printer 30 of FIG. 1 comprising the housing 31, the supply door 32, and the example printing fluid supply carrier 10 of FIG. 1 during installation to the printer 30. The printing fluid supply carrier 10 can be connected to the printer 30. In some examples, the printing fluid container carrier 11 is pushed through the opening area 34 and thereby inserted into the housing 31.

In some examples, the printing fluid supply carrier 10 can be part of the CISS mounted to the printer 30. In some examples, the printing fluid supply carrier 10 includes components of the CISS, such as refill printing fluid containers and tubing which can be connected via the opening to the printing fluid supply area 40. The refill printing fluid container may include a quantity of printing fluid, which is to replenish the printing fluid in a printing fluid container 41 located inside the printer housing 31. Thus, before the printing fluid supply carrier 10 including the CISS can be installed to the printer 30 the supply door 32 has to be opened thereby opening the printing fluid supply area 40. In some examples, the supply door 32 may be opened by opening the supply door 32 downwards, upwards or sideways and thereby uncovering the opening to the printing fluid supply area 40 at least in part.

In some examples, the cover part 11 may cover the opening area 34 of the one side of the printer housing 31, the printing fluid supply area 40 and the supply door 32 opening the printing fluid supply area 40. In some examples, the printing fluid supply carrier 10 comprises a supply door compartment 42 (illustrated by dashed lines, indicating that the supply door compartment 42 is not apparent when the printing fluid supply 10 is installed and the supply door 32 opens the opening to the printing fluid supply area 40) to accommodate the supply door 32 of the printer 30 when the printing fluid supply carrier 10 is installed to the printer 30.

Figure 5:
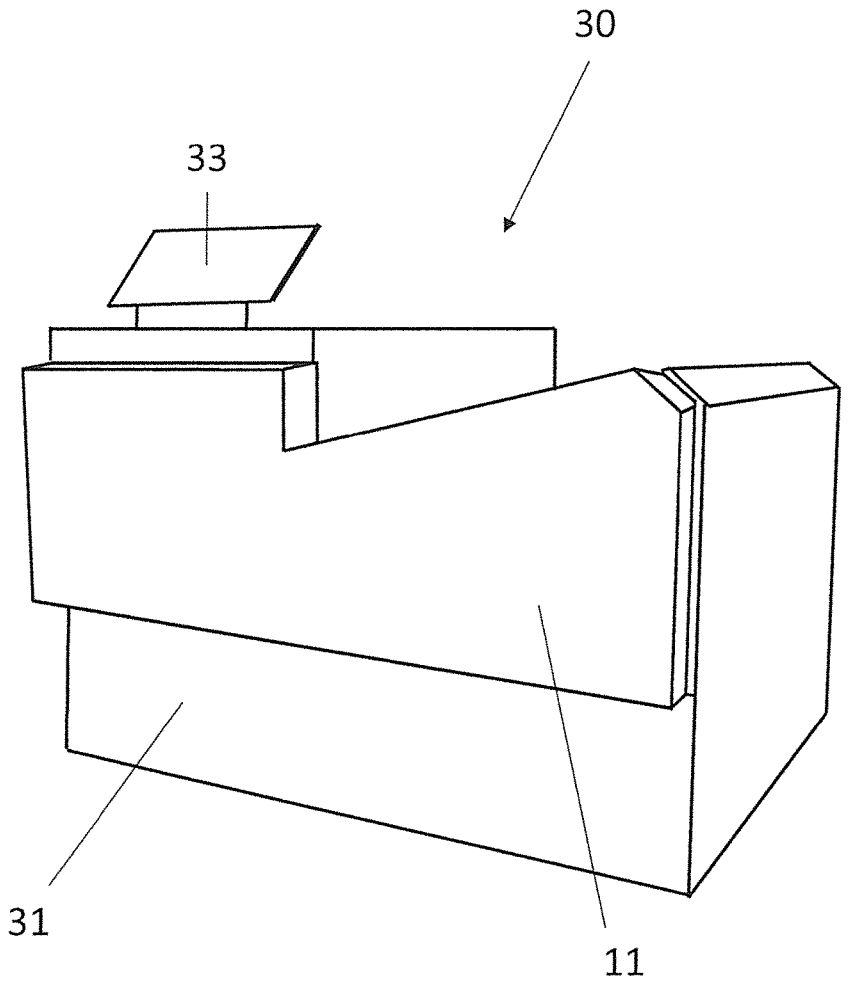
FIG. 5 is a further side view of a schematic illustration of the example printer comprising the housing, the supply door and the printing fluid supply carrier when installed to the printer.

Now referring to FIG. 5, which illustrates the example printer 30 comprising the housing 31, the supply door 32 and the printing fluid supply carrier 10 when installed to the printer 30. In some examples, the printing fluid supply carrier 10 engages with the housing 31. In some examples, the printing fluid container carrier 11 may be completely inserted into the opening area 34 of the printer 30. Thus, when installed to the printer 30, the cover part 12 that projects along the one side of the printing fluid container carrier 11 fits closely with the side wall of the printer housing 31 having the opening area 34 and the supply door 32. In some examples, the printing fluid container carrier 11 may fit precisely with the inner surface of the free space of the opening area 34 of the housing 31 to provide stable support to the junction of the printing fluid supply carrier 10 with the printer housing 31.

The cover part 12 has a depth extending in y-direction that may be sufficient to accommodate the supply door 32 opening the opening to the printing fluid supply area 40. In some examples, the left side part of the protruding part of the cover part 12 accommodates the supply door 32 being left in an open state. In some examples, the right side part of the cover part 12 covers the opening area 34 completely.

The width of the cover part 12, i.e., the extension in x-direction, corresponds substantially to the width of the printer housing 31. In this context, substantially means that the cover part 12 has a width which is at most 10% smaller, or at most 5% smaller than the printer housing 31. In some examples, the width of the cover part 12 is identical with the width of the printer housing 31. In some examples, the extension of the cover part 12 in z-direction is adapted to correspond with the extension of the printer housing 31 in z-direction.

When the printing fluid supply carrier 10 is installed to the printer 30, the printing fluid supply carrier 10 acts as the supply door 32. In some examples, the printer 30 comprises a sensor to detect the supply door 32 closing the opening to the printing fluid supply area 40. The cover part 12 of the printing fluid supply carrier 10 comprises a sensor counter-part 22 for ensuring the sensor of the printer 30 to detect that the opening to the printing fluid supply area 40 is covered by the cover part 12, when the printing fluid supply carrier 10 is installed to the printer 30. Thus, the supply door 32 can be left open to allow the CISS tubing freedom and also a clean OEM look to the printing fluid supply carrier 10. Further, even though the supply door 32 is left open, the printer system can be safely operated as the printing fluid supply carrier 10 integrates the sensor counter-part 22 thereby acting as the supply door 32.

While several examples have been described in detail, it is to be understood that the disclosed examples may be modified. Therefore, the foregoing description is to be considered non-limiting.

What is claimed is:

1. A replaceable printing fluid supply carrier for a continuous ink supply system of a printer, the printer including a supply door opening to a printing fluid supply area and a sensor to detect whether the supply door is in a closed position relative to the opening to the printing fluid supply area, the printing fluid supply carrier comprising:

a printing fluid container carrier;

a cover part connected to the printing fluid container carrier, the cover part to cover the opening to the printing fluid supply area when the printing fluid supply carrier is installed to the printer; and a sensor counter-part associated with the cover part, the sensor counter-part to interact with the sensor of the printer, the sensor to detect whether the opening to the printing fluid supply area is covered by the cover part when the printing fluid supply carrier is installed to the printer.

2. The printing fluid supply carrier according to claim 1, wherein the sensor counter-part of the printing fluid supply carrier includes a magnet integrated within the cover part of the printing fluid supply carrier.

3. The printing fluid supply carrier according to claim 1, further including a supply door compartment to accommodate the supply door of the printer when the printing fluid supply carrier is installed to the printer.

4. The printing fluid supply carrier according to claim 1, wherein the cover part includes a handle.

5. The printing fluid supply carrier according to claim 1, wherein the printing fluid container carrier includes a refill printing fluid container to be fluidly connected via the opening to the printing fluid supply area with a printing fluid container located inside the printer.

6. The printing fluid supply carrier according to claim 5, wherein the cover part includes a level indicator to indicate the fill level of the refill printing fluid container.

7. The printing fluid supply carrier according to claim 5, wherein the cover part includes a section through which the fill level of the refill printing fluid container is visible.

8. A printer comprising:

a housing including an opening to a printing fluid supply area within the housing;

a supply door attached to the housing, the supply door to selectively provide access to the printing fluid supply area via the opening;

a sensor to detect the supply door in a closed position relative to the opening to the printing fluid supply area; and a replaceable printing fluid supply carrier for a continuous ink supply system, the printing fluid supply carrier including:

a printing fluid container carrier;

a cover part connected to the printing fluid container carrier, the opening is covered in lieu by the cover part of the printing fluid supply carrier; and a sensor counter-part associated with to the cover part, the sensor counter-part to interact with the sensor of the printer, the sensor to detect whether the opening to the printing fluid supply area is covered by the cover part when the printing fluid supply carrier is installed to the printer.

9. The printer of claim 8, wherein the sensor counter-part is a first sensor counter-part, the printer further including a second sensor-counterpart associated with the supply door, the sensor to detect the presence of either the first sensor counter-part or the second sensor counter-part.

10. The printer of claim 9, wherein the first sensor counter-part is in a location when the printing fluid supply carrier is coupled to the printer, and the second sensor counter-part is in the location when the printing fluid supply carrier is not coupled to the printer and the supply door is in the closed position.

11. The printer of claim 10, wherein the printer is in an operational state when the first sensor counter-part or the second sensor counter-part is in the location.

* * * * *